United States Patent [19]

Agabekov

[11] Patent Number: 4,569,568

[45] Date of Patent: Feb. 11, 1986

[54] ADAPTER FOR TUBULAR ELECTRIC LAMP FIXTURE

[76] Inventor: Youri Agabekov, 73, route de Thonon, 1222 Vésenaz, Switzerland

[21] Appl. No.: 636,375

[22] Filed: Jul. 31, 1984

[30] Foreign Application Priority Data

Aug. 2, 1983 [CH] Switzerland ..... 4196/83
Jun. 6, 1984 [CH] Switzerland ..... 3087/84

[51] Int. Cl.[4] ..... H01R 13/00

[52] U.S. Cl. ..... 339/154 A; 339/20; 339/52 R; 339/176 L

[58] Field of Search ..... 339/20, 154 A, 154 L, 339/155 L, 182 L, 154 R, 176 L, 59 L, 52 R, 57, 53, 52 S, 50 R, 54, 55, 21 R, 22 R, 51

[56] References Cited

U.S. PATENT DOCUMENTS 12,907 1/1889 Beuttell ..... 339/57
744,387 11/1903 O'Brien ..... 339/53
2,716,739 8/1955 Lemmers ..... 339/50 R
3,003,058 10/1961 Babcock ..... 339/176 L
3,400,262 9/1968 Newman et al. ..... 339/97
3,911,266 10/1975 Oram ..... 339/176 L
4,418,973 12/1983 Smetana et al. ..... 339/97 L
4,482,944 11/1984 Roosine et al. ..... 339/59 L

*Primary Examiner*—Gil Weidenfeld
*Assistant Examiner*—Thomas Kline
*Attorney, Agent, or Firm*—Gunn, Lee & Jackson

[57] ABSTRACT

Adapter for the insertion of a pin contact lighting lamp into an electric supply fixture bar. The fixture bar has an insulating support and a plurality of electric contact tabs along the support for contacting a current consuming element having electrical supply contacts at its ends. The adapter allows for the use of halogen lights with pin contacts and extends parallel to the fixture bar. A second type of adapter is orientable and fitted for being directed toward a precise point to be illuminated.

16 Claims, 9 Drawing Figures

ADAPTER FOR TUBULAR ELECTRIC LAMP FIXTURE

BACKGROUND OF THE INVENTION

This invention belongs to the technical field of lighting and relates to an adapter or a fitting for connecting a contact pin lighting lamp to a fixture for a plurality of tubular electric lamps, having an elongated frame and a plurality of pairs of tubular lamps carrying tabs which are fitted at their ends with electric contacts.

DESCRIPTION OF THE PRIOR ART

Elongated multicontact conductor bars for electric supply to tubular current consumers such as tubular lamps having contact caps at both ends, can already be found on the market. The adapter of the invention is particularly fitted for the use with electric current supply bars disclosed in pending U.S. Ser. No. 502,682 of June 17, 1983, of the applicant. That type of electric current supply bars can also be termed as lighting bars, and they appear in the shape of elongated insulated support frames holding a linear array of tubular lamps. These support frames may be used to illuminate shop-windows, the interior of bookcases, cupboards and wardrobes, blackboards, etc.

These electric supply bars are normally fitted with tubular lamps, and it is intended, of course, that the lamps should constitute a very thin lighting unit. Should high powered lamps be used, adapters would be necessary to insert such other lamps into the supply bar since high powered lamps have pin contacts instead of caps on both ends of a tube, said pins protruding from one and the same end of the lamp bulb.

SUMMARY OF THE INVENTION

A first object of the present invention is to provide a first embodiment of an electric adapter allowing to use lamps having an elevated power, for example halogen lamps, and a pin or flat pin contact base, in such a manner that these lamps do not require much more space than the double ended tubular lamps for which the fixture bar is orginally designed.

Another object of the invention is to provide an adapter of the depicted kind allowing to realize a fixture bar resulting in a much more intensive illumination compared with a lighting to be realized with double ended tubular lamps.

Still another object of this invention is to provide a second realization of an adapter which allows to insert and to use pin contact· lamps, for example halogen lamps, in order to illuminate a special point. Such an adapter should thus permit to add a high powered orientable lamp to the tubular lamp fixture bar previously provided with tubular double-ended lamps or halogen lamps—using the first embodiment of the adapter—, and to direct the beam or spot from this lamp to a predetermined location. Thereby, it may be allowed that the second type adapter would protrude from the body of the fixture bar and form a structure emerging from the bar. Such structure could be pivoted laterally.

Now, these objects and still others are met by the fixture adapter of the invention, which permits the insertion of two-pin lamps into the above mentioned fixture for double-ended tubular lamps. This adapter comprises in its first main embodiment an insulating socket fitted with female contact bushes for receiving the contact pins of the lamp; a first conducting part fixed to said socket and extending on one side of the socket as to constitute a reflector for the lamp to be inserted into said bushes, and a second conducting part fixed to said socket and extending on the other side of the socket, each of said two conducting parts being electrically connected to each one of said two female bushes of the socket and being adapted to be fixed between two respective and corresponding electric contact tabs of the supply bar, the lamp inserted into the adapter being connected in parallel to the fixture in said bar and separated from said fixture by the reflector which forms the first conducting part of the adapter.

The ends of the two conducting parts may be pushed out or bordered outwardly to form a fixing stud which fits in with a corresponding configuration or a boring in the electric contact tabs of the fixture bar.

In a preferred embodiment of the invention, the adapter is shaped for being introduced in a fixture bar which comprises an insulating support bar formed by two perpendicular flanges; said first conducting part forming the reflectors is shaped as to have also two perpendicular flanges which come into mechanical contact with the inner surfaces of the insulating support flanges when the adapter will be inserted between the corresponding contact tabs of the fixture bar. The first conducting part forming the reflector may be realized from four flanges of a blank cut from a conducting sheet and folded to form a box fitting in with the inner section of the support in the fixture bar.

The two conducting parts may be riveted in the insulating socket.

A second embodiment of the adapter which is orientable with respect to a fixture bar comprising an insulating support and a plurality of electrical contact tabs for receiving a current consuming device having supply contacts at its ends, comprises an insulating socket equipped with female contact bushes to receive the contact pins of the lighting lamp, said socket being fitted with two conducting parts electrically connected to said female contact bushes and extending from the side of the socket opposed to the lamp receiving side, the two conducting parts being shaped to be inserted between the two contact tabs of a contact pair of the fixture bar in such a manner that the socket may be rotated in a plane perpendicular to the lengthwise axis of said fixture bar. In this way, the beam of said lamp inserted into the socket may be directed and positioned to be illumitated.

The ends of the two conducting parts may comprise outwardly pushed or bordered regions thus forming a fixing stud to be introduced into a correspondingly shaped part or a boring in the electric contact tabs of the fixture bar.

Radially extending ribs are provided around the bordered zones such as to form sharp edged surfaces destined to come into contact with corresponding grooves in the electric contact tabs of the fixture bar thus allowing a firm positioning of the socket relative to the bar.

In another preferred embodiment, the bordered zones of the conducting parts which form fixing studs are shaped in such a manner that their surface opposed to that one which is to come in contact with the electric tabs of the fixture bar is prepared to receive the bordered region of a conducting part or other adapter or current consumer, and the conducting parts have the shape of two parallel metallic strips whose free ends are of circular shape.

The insulating socket has the shape of a hexagonal block having lateral borings for riveting the two conducting parts which extend parallel to each other to the same side of said block, the lamp being inserted from the other side. The spacing of the two conducting parts to be mounted on two electric contact tabs of the fixture bar is selected to correspond to the spacing of two adjacent contact tabs of two pairs which are each destined to receive a tubular current consuming element. In this manner, each of the contact pairs of the fixture bar may be fitted with one current consuming element, especially lamps, and each spacing between two adjacent contact tabs of each pair may receive an adapter with its lamp.

The end portion of the second conducting part may be provided with at least one bent portion so that this end portion will serve as a spring means to the unit when the adapter is inserted between the said contact tab pair of the fixture bar.

The two conducting parts and the female contacts of the socket may be connected to each other by contact strips forming an integral piece with the conducting parts.

BRIEF DESCRIPTION OF THE DRAWING

The drawing represents embodiments of the first type of adapter for the fixture of a lighting lamp, allowing the use of halogen lamps having pin contacts and extending parallel to the fixture bar, and embodiments of the second type of adapter being orientable and fitted for being directed toward a precise point to be illuminated.

In the drawing.

DETAILED DESCRIPTION OF PREFERRED EMBODIMENTS

Figure 1:
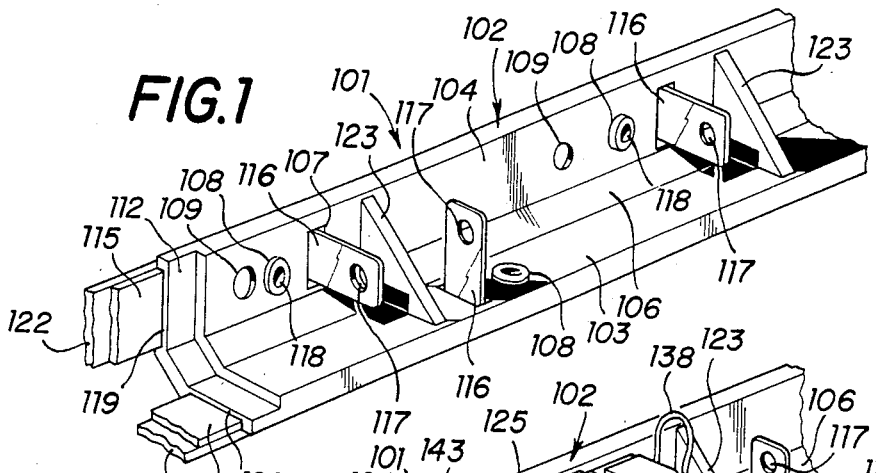
FIG. 1 is a perspective view of a section of an electric supply and fixture bar for receiving current consuming elements with double-ended contacts, for example a tubular lamp or an adapter of the invention to be described.
Figure 2:
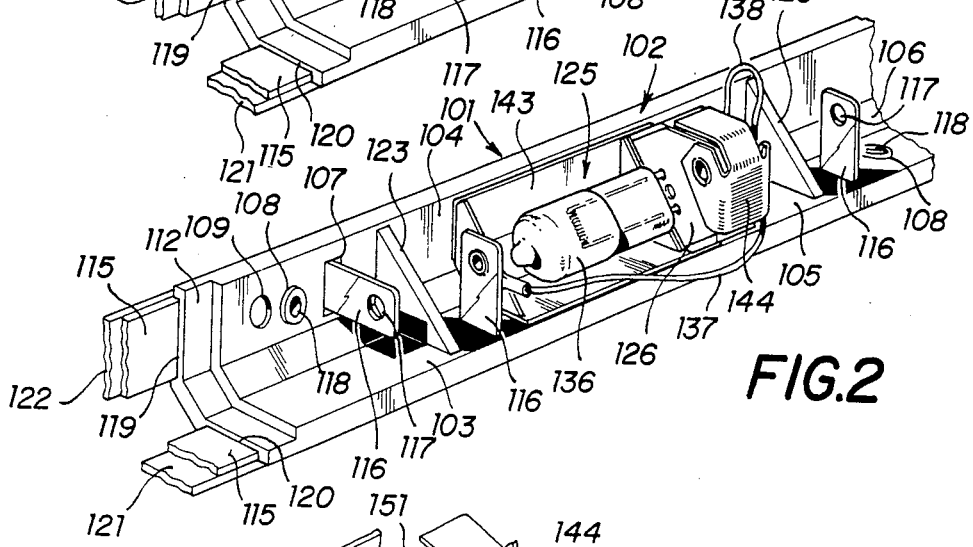
FIG. 2 is the same perspective view of part of the electric supply bar as in FIG. 1, the bar of FIG. 2 being equipped with a first embodiment of the adapter for receiving a pin contact lighting lamp.

The fixture bar 101, a portion of which is shown in FIGS. 1 and 2 as a perspective view, comprises a support 102 of insulating material, for example synthetic plastics material, on which electric conductors and connecting means are mounted as it will be described below. The support 102 of insulating material which is shown as a portion in FIGS. 1 and 2, has the shape of a module having final connecting grooves. A plurality of identical modules of even length may be combined in lengthwise arrangement thus allowing to realize a supply or illumination bar of a selected length. Each of these modular supports 102 is made of insulating material, for example synthetic plastics material, and comprises two flat flanges 103 and 104 perpendicular to one another and connected by a flat central web 105 of a length slightly inferior to that of the flanges 103 and 104. The central web 105 forms an angle of 135° with each of the flanges 103 and 104. The flanges 103 and 104 have slots 107 in transversal arrangement with reference to the lengthwise axis of the module of support 102 and are regularly spaced over its length. Holes 108 are provided in the neighbourhood of each slot 107 in a predeterminated distance from that slot 107. The hole 108 is at the left of the corresponding slot 107 on the flange 104 and at the right of a slot 107 on the flange 103. The flanges 103 and 104 have further additional holes 109 to receive fixing means such as screws or nails (not shown). The slots 107 are destined to receive protruding parts or electric contacts being part of conducting strips with which the support 102 is equipped. These protruding parts or electrical contacts will be described below.

The end portions of support 102 have a transversally retracted portion 112 diminishing by the half the thickness at the ends of the module on a predeterminated length, destined to receive the corresponding portions (not shown) of the following module. The electric conductors of the bar 101 are shaped as metallic strips 115 having punched out parts 116 at regular intervals and bent at 90° from the plane of the strip 115. These punched out portions 116 will form the protruding parts or electric contact tabs which will serve as electric connecting points for the current consuming elements. They have at their ends a hole 117 permitting the lateral positioning of the electric contacts of the current consuming elements which will be placed between two tabs 116. The metallic strips 115 are fixed to the support 102 by rivets 118 inserted into the holes 108 provided on said support. As it can be seen from FIGS. 1 and 2, the metallic strips 115 are placed against the back of flanges 103 and 104 into grooves 119 and 120. The strips 115 are then covered by self-adhesive bands 121 and 122. The support 102 is further equipped with reinforcing ribs or struts 123 which delimit between each other the space reserved for a current consuming element.

Figure 7:
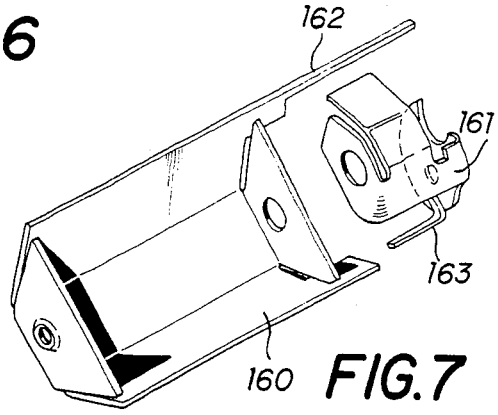
FIG. 7 is the view of a variant of two conducting parts forming the end contacts of the adapter of FIGS. 2 to 6.
Figure 8:
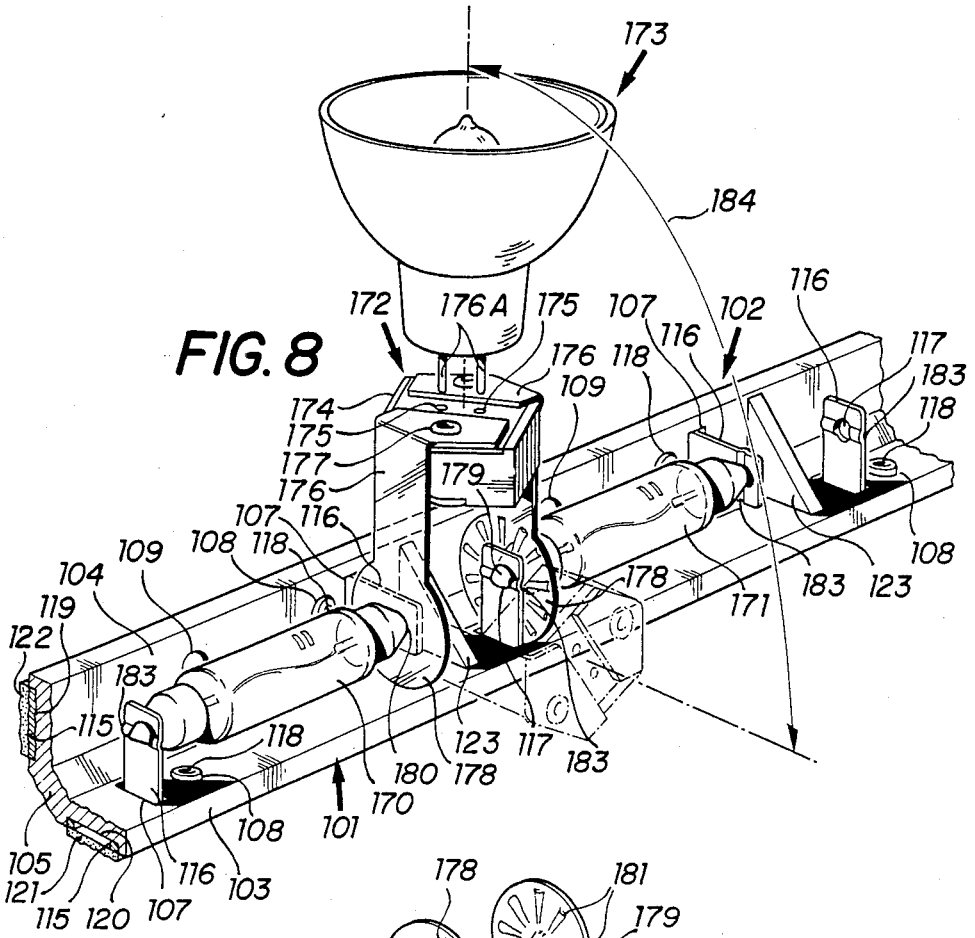
FIG. 8 is a perspective view of a section of an electric supply bar as referred to in FIGS. 1 to 6, the bar being equipped with a second embodiment of an adapter, orientable and capable of receiving a lamp having pin contacts.

The bar which has just been described is normally used as an illuminating bar when equipped with tubular lamps (shown in FIG. 8). The electric contacts 116 may however receive other current consuming elements which may be inserted between two contacts 116. The first embodiment of an adapter 125 represented in FIGS. 2 to 7 is a current consuming element allowing the use of a pin contact lamp and especially of a halogen lamp. This element 125, equipped with halogen lamps, will permit to realize a much more intensive lighting compared with conventionnal tubular lamps. That adapter 125 is to be inserted into the interior of the bar 101, the halogen lamp being within the axis of said bar, and the unit will remain to be a fine and slim bar having no protruding constituent.

Figure 3:
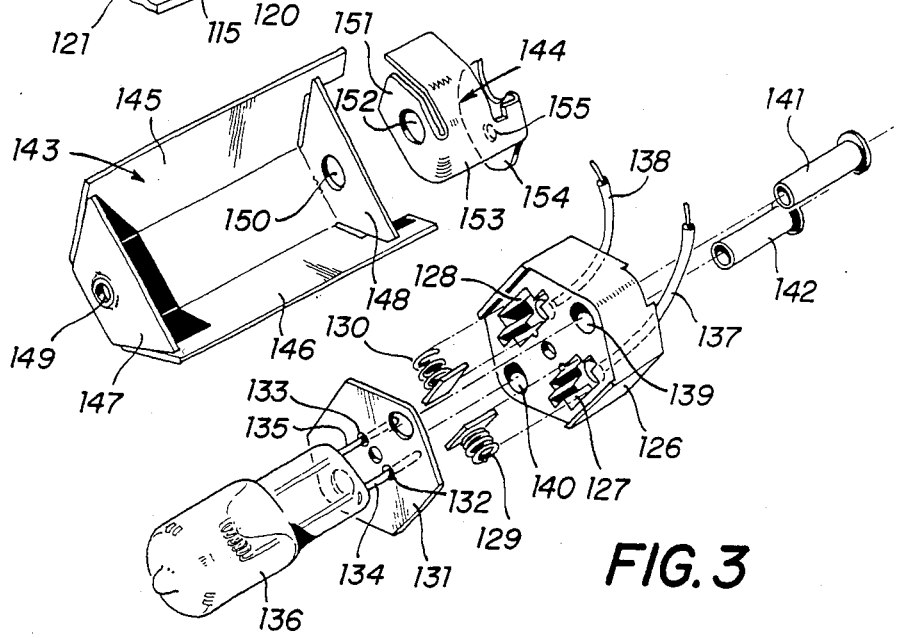
FIG. 3 is an exploded view of the adapter of FIG. 2, equipped with a pin contact halogen lamp.
Figure 4:
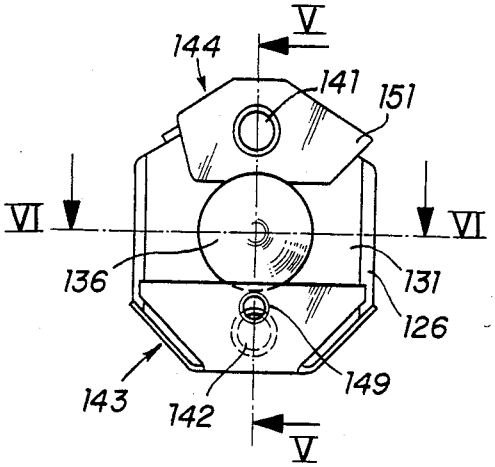
FIG. 4 is a front view of the adapter of FIGS. 2 and 3.
Figure 5:
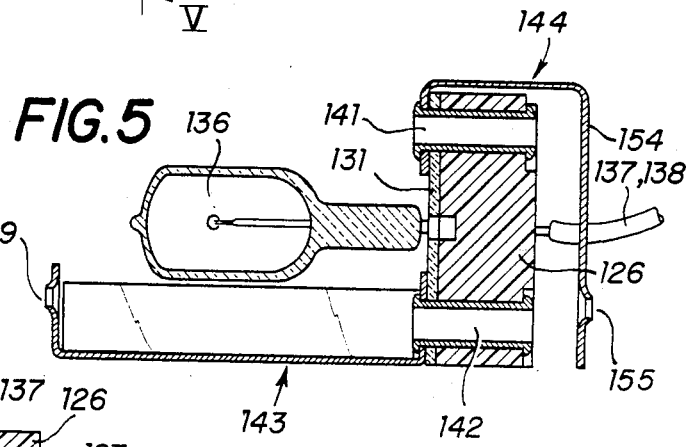
FIG. 5 is a cross-sectional view along the line V—V of the adapter of FIG. 4.
Figure 6:
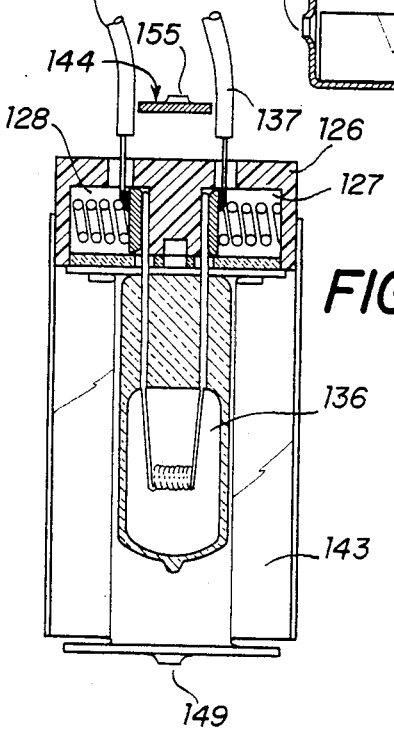
FIG. 6 is a cross-sectional view along the line VI—VI of the adapter of FIG. 4.

The adapter 125 shown in an exploded view in FIG. 3 comprises a socket 126 shaped as a hexagonal block, the socket 126 having apertures 127 and 128 to receive female contacts 129 and 130 of the socket. As it can be seen in FIG. 3, these female contacts are executed as a tiny plate and a spring, and these parts are introduced into an aperture 127 and 128, respectively. The socket 126 is covered by a plate 131 having holes 132 and 133 for receiving the two pins 134 and 135 of a halogen lamp 136. The pins 134 and 135 will be introduced, when the unit is mounted, between the apertures 127 and 128, and the tiny plates of the female contacts 129 and 130. The wires 137 and 138 introduced from the other end of the apertures 127 and 128 will establish the contact with the pins 134 and 135 of the lamp 136. The socket 126 has another two boring holes 139 and 140 to receive fixing rivets 141 and 142. These rivets 141 and 142 are destined to connect the conducting parts 143 and 144 to the socket 126; the parts 143 and 144 will serve as contacts which will be inserted between electric contacts 116 of the bar 101 described with respect to FIGS. 1 and 2. The free ends of the wires 137 and 138 may be connected with the end portions of the conducting parts 143 and 144 as schematically shown in FIGS. 2 and 3, or alternatively directly to the rivets 141 and 142.

As it can be seen in FIGS. 3 to 6, the conducting part 143 has a shape of a reflector and is manufactured from a cut-out metallic sheet. The four flanges 145, 146, 147 and 148 are bent such as to form the reflector in front of which the lamp 136 will be placed. Part 143 is shaped in such a manner that its surfaces fit in with the interior of the bar 101 shown in FIGS. 1 and 2. On one hand, part 143 serves as a reflector for the halogen lamp 136, and on the other hand as a heat shield between the lamp 136 and the plastic material support 102. The reflector part 143 has finally on its exterior surface 147 a bordered portion 149 which forms a fixing stud which will be introduced into the hole 117 of the electric contact tab 116 on the bar 101. At the other extremety, the flange 148 of the part 143 has a boring 150 to receive the fixing rivet 142 for securing part 143 to the socket 126.

The second conducting part 144 has a fixing portion 151 comprising a hole 152 to receive the fixing rivet 141 for securing part 144 to the insulating socket 126. The portion 151 is followed by a bent portion 153 and an end portion 154 also equipped with a bordered or pushed-in portion 155 which forms a fixing stud for being introduced into the hole 117 of the electric contact tab 116 on the bar 101. Finally, the electric connecting wires 137 and 138, respectively, connected to female contacts 129 and 130, respectively, will be fixed on the conducting parts 143 and 144, respectively. The contact between the two pins 134 and 135 of the halogen lamp and two contacts 116 of the bar 101 is established in this manner.

FIG. 7 shows a variant of a conducting part 160 and 161. Parts 160 and 161 have the same configuration as parts 143 and 144 shown in FIGS. 3 to 6 but comprise additionnaly latches 162 and 163 cut out integrally with each of parts 160 and 161. These latches 162 and 163 are provided to establish the electric contact between the parts 160 and 161, respectively, and the female electric contacts 129 and 130, respectively, within the insulating socket 126. When latches 162 and 163 are present, electric connection wires 137 and 138 can be avoided. The latches 162 and 163 may thus be bent and inserted into the borings 127 and 128 when parts 160 and 161 are riveted onto the socket 126.

The supply bar 101 represented in FIG. 8 in partly exploded perspective view is identical to the bar of FIGS. 1 and 2 and comprises an insulating support 102 on which the electric conducters and connection means as already described are applied and fixed. The insulating support 102 can also be shaped as a module having at it ends connecting grooves (not shown). As it has already been described, several modules of the same length and identical to each other can be placed in serial relationship, and this arrangement allows to combine a supply or illuminating bar of a selected length. Each of these modules or supports 102 is executed of insulating material, for example a plastic material, and comprises two flanges 103 and 104 which are perpendicular to each other and connected by a central web 105 whose length is slightly inferior to that of the flanges 103 and 104. The central web 104 forms an angle of 135° with each of the flanges 103 and 104. These flanges 103 and 104 comprise regularly spaced slots 107 along the support and arranged in transversal relationship to the lengthwise axis of the module or support 102. The hole 108 is at the left of the corresponding slot 107 on the flange 104 and at the right of a slot 107 on the flange 103. The flanges 103 and 104 have further additional holes 109 to receive fixing means such as screws or nails (not shown).

The electric conductors of the bar 101 are shaped as metallic strips 115 having punched out parts 116 at regular intervals and bent at 90° from the plane of the strip 115. These punched out portions 116 will form the protruding parts or electric contact tabs which will serve as electric connecting points for the current consuming elements. They have at their ends a hole 117 permetting the lateral positioning of the electric contacts of the current consuming elements which will be placed between two tabs 116. The metallic strips 115 are fixed to the support 102 by rivets 118 inserted into the holes 108 provided on said support. As it can be seen from FIGS. 1 and 2, the metallic strips 115 are placed against the back of flanges 103 and 104 into grooves 119 and 120. The strips 115 are then covered by self-adhesive bands 121 and 122. The support 102 is further equipped with reinforcing ribs or struts 123 which delimit between each other the space reserved for a current consuming element.

Figure 9:
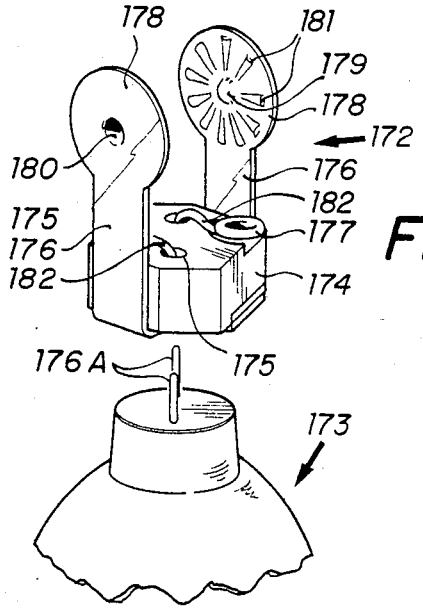
FIG. 9 is a view from below of the adapter of FIG. 8 inserted into the fixture bar.

The fixture bar just described is normally used as an illuminating bar equipped with tubular lamps 170 and 171. As shown in FIGS. 8 and 9, an adapter 172 provided for receiving a halogen lamp is branched between two electric contact tabs 116 separated by the rib 123. The two electric contact tabs 116 whereon the adapter 172 is branched are in principle adjacent contact tabs of two contact tab pairs provided each to receive a current consuming element such as tubular lamp 170 or 171, respectively. The arrangement of the electrical contact tabs 116 which form these pairs, resulting from a supply alternance from the two metallic strips 115 allows the insertion of the adapter 172 between the adjacent contact tabs of the contact tab pairs where electrical current consumers are already inserted, especially the tubular lamps 170 and 171.

The supply bar 101 may such be equipped with current consuming elements 170, 171, . . . , between each pair of contact tabs 116 existing within a space limited by two ribs 123 and/or also adapters 172 beween two adjacent contact tabs of each pair, the adapters 172 bridging the ribs 123.

The adapter 172 comprises an insulating socket 174 having the shape of a hexagonal block of the same kind as such of the adapter shown in FIGS. 1 to 7. The socket 174 has borings 175 containing electrical contacts (not shown) provided to receive contact pins 176A of a lamp 173. On each side of the insulated socket 174 are fixed connecting tabs 178 by rivets 177. The connecting tabs 176 are parallel to each other and have at their ends rounded portions 178 with a central fixing stud 179. The studs 179 of the two rouded portions look towards each other and are centrally placed at the inner surface of the portions 178 so that they may be inserted into the holes 117 of the electric contact tabs 116 when the adapter 172 is set to said contact tabs. The studs 179 are made by pushing out the central material in the rounded portions 178 to form a hole 180 in the exterior surfaces of the parts. Once the adapter 172 is mounted on the electric contact tabs 116, the rounded portions 178 are on the exterior of the two contact tabs 116 which are situated on both sides of the rib 123. In this manner, the holes 180 may receive the ends of the tubular lamps 170 and 171 should they be mounted together with adapters 172.

Finally, the ending portions 178 have on their interior surface radial ribs 181 which fit in with grooves 183 in the electric contact tabs 116 so that the adapter 172 may be positioned relatively to said contact tabs between two extreme positions forming an angle 184 of 90°, shown in FIG. 8 in plain and dashed lines. The user may thus direct the lamp 173 towards a precise point in pivoting the adapter 172 on the contact pins 116 in order to light that point. Due to the radial ribs 181 and the grooves 183, the lamp 173 will remain in the selected position. The electrical connection between the contact tabs 116 of the supply bar 101 and the pin contacts 176A of the lamp 173 is effected by means of the connecting tabs 176, the rivets 177 and the electrical wires 182 emprisoned at one end by the rivets 177 and connected with the other end to contacts (not shown) in the interior of borings 175 in the insulated socket 174 to receive the contact pins 176A of lamp 173.

The adapters which have now been described with reference to FIGS. 1 to 7 and 8 and 9, respectively, may be modified in details. These adapters allow the use of pin contact lamps in an electric supply bar only provided for current consuming element having double ended contacts.

The first embodiment of the adapter described with respect to FIGS. 1 to 7 has the advantage of using a contact pin lamp which is inserted in parallel to the axis of the electrical supply bar. In this manner, the adapter of FIGS. 1 to 7 does not take together with its lamp more place than a simple tubular double ended lamp. On the other end, the conducting part 143 constitutes by its design a means for the lamp to being a projector and allows furthermore to be a shield between the lamp and the plastic material of the support of the bar. This fact is particularly important when halogen lamps are used which develop a relatively high amount of heat. The surface and the volume of the part 143 allows the dissipation of this heat avoidsand its concentration on a limited region of the support part 102. Finally, the fact that the lamp is placed with its pins in parallel to the axis of the bar 101 permits the realization of a lighting lamp having a great power without creating parts outstanding from said bar. The thus equipped bar has dimensions equivalent to those of a bar equipped with only tubular lamps.

The advantage of the second embodiment of the adapter according to FIGS. 8 and 9 is based on the fact that it may be directed towards a particular point to be illuminated and remains positioned towards this point, even in the case where the bar wherein it is inserted is liable to chocs or vibrations. On the other hand, it offers the adavantage that it can be placed on the bar even if all the emplacements to receive normal current consuming elements are already occupied. An adapter 172 may thus be added to a bar between two adjacent current consuming elements, for instance between tubular lamps and/or adapters as described with reference to FIGS. 1 to 7.

The adapters of this invention can be changed in details according to the ordinary knowledge of the man skilled in the art. The invention is not limited by the description of preferred embodiments thereof, the scope of protection being only defined by the appended claims.

I claim:

1. Adapter for the insertion of a pin contact lighting lamp into an electric supply fixture bar, said fixture for having an insulating support and a plurality of electric contact tabs along the support for contacting a current consuming element having electrical supply contacts at its ends, the adapter comprising (a) an insulating socket equipped with female contacts to receive contact pins of said lighting lamp;

(b) a first conducting part secured to and extending from one side of said socket, shaped such as to serve as a reflector for said lamp inserted into said female socket contacts; and (c) a second conducting part secured to and extending from the other side of said socket, said two conducting parts being electrically connected to said female socket contacts and designed as to fit in between two successive contact tabs of said supply bar, the lamp inserted into the adapter being parallel to the lengthwise axis of said support of the bar and separated from said support by the reflector formed by the first conducting part.

2. The adapter of claim 1 wherein the end portions of said two conducting parts have a pressed-in portion which forms a fixing stud for being introduced into a corresponding portion or a hole in the electric contact tabs of contact pairs of the supply bar.

3. The adapter of claim 1 or 2 for a supply bar having an insulating support made by two mutually perpendicular flanges, wherein said first conducting part which forms the reflector comprises two perpendicular flanges to come into contact and to fit in with the interior surfaces of the flanges of said insulating support when inserting the adapter between a contact tab pair of said fixture bar.

4. The adapter of claim 3, wherein the first conducting part which forms the reflector is made from a four flanged blank cut out of a conducting sheet and folded to form a box fitting in with the interior of the support profile of said supply bar.

5. The adapter of claim 1 wherein said two conducting parts are riveted to the insulating socket.

6. The adapter of claim 1 wherein the end portion of the second conducting part is connected by at least one bent off portion to a body of said second conducting part, said bent off portion permitting said end portion to serve as a spring means on the insertion of the adapter between said pair of contact tabs in the bar

7. The adapter of claim 1 wherein said two conducting parts are connected by electric wires to said female socket contacts.

8. The adapter of claim 1 wherein said two conducting parts are connected to said female socket contacts by means of contact latches made as an integral portion with said conducting parts.

9. The adapter of claim 1 wherein said socket is a hexagonal block having lateral borings for securing said two conducting parts to laterally opposed sides of the block by means of rivets.

10. Adapter for the insertion of a pin contact lighting lamp into an electric supply fixture bar, said fixture for having an insulating support and a plurality of electric contact tabs along the support for contacting a current consuming element having electrical supply contacts at its ends, the adapter comprising an insulating socket equipped with female contacts to receive contact pins of said lighting lamp;

said socket having secured thereto two conducting parts electrically connected to said female socket contacts and extending at the side of the socket which is opposed to its lamp receiving side, said two conducting parts being designed as to fit in to two contact tabs of the supply bar in such a manner that said socket is pivotable in a plane perpendicular to the axis of the bar, thus permitting the direction and the positioning of the light beam from the lamp in said socket towards a given point to illuminate.

11. The adapter of claim 10 wherein the end portions of said two conducting parts have a pressed-in portion which forms a fixing stud for being introduced into a corresponding portion or a hole in the electric contact tabs of the contact pairs of the supply bar.

12. The adapter of claim 11 wherein radial ribs are provided around the pressed-in portions forming the fixing studs, to form sharp surfaces which come into contact with grooves provided on said electric contact tabs of the supply bar and to allow the positioning of the socket relatively to said bar.

13. The adapter of claim 11 wherein the pressed-in portions of the conducting parts, forming the fixing stud which fits in with a corresponding portion or a hole in the contact tabs of said bar, are modeled in such a manner that their side not being in touch with said contact tabs of the bar is capable of receiving another pressed-in portion of a conducting part of another adapter or current consumer.

14. The adapter of claim 10 wherein the conducting parts comprise two parallel metal strips having circular free end portions.

15. The adapter of claim 10 wherein the insulating socket comprises a hexagonal block having lateral borings to receive fixing rivets for the two conducting parts extending in parallel on the same side of said block, the lamp being introduced into the socket from the other, free side.

16. The adapter of claim 10 wherein the spacing of the two conducting parts to be inserted on two electric contact tabs of the supply bar, is selected such as to correspond to the spacing of two adjacent contact tabs of two adjacent pairs which each are destined to receive a current consuming element.

* * * * *